US007513258B2

(12) United States Patent
Kollasch et al.

(10) Patent No.: US 7,513,258 B2
(45) Date of Patent: Apr. 7, 2009

(54) DISPOSABLE FILTER MEANS FOR SMOKING

(75) Inventors: Stefan Kollasch, Brisbane (AU); Brad Teys, Sunshine Coast (AU)

(73) Assignee: Piparette Pty Ltd, Brisbane (AU)

( * ) Notice: Subject to any disclaimer, the term of this patent is extended or adjusted under 35 U.S.C. 154(b) by 563 days.

(21) Appl. No.: 10/995,550

(22) Filed: Nov. 24, 2004

(65) Prior Publication Data

US 2005/0217683 A1 Oct. 6, 2005

Related U.S. Application Data

(63) Continuation-in-part of application No. 10/496,492, filed as application No. PCT/AU02/01554 on Nov. 15, 2002, now abandoned.

(30) Foreign Application Priority Data

Nov. 23, 2001 (AU) ..... PR9023

(51) Int. Cl.
*A24F 13/00* (2006.01)

(52) U.S. Cl. ..... 131/329

(58) Field of Classification Search ..... 131/329
See application file for complete search history.

(56) References Cited

U.S. PATENT DOCUMENTS

| | | | | |
|---|---|---|---|---|
| 3,774,624 | A * | 11/1973 | Fassbender | 131/201 |
| 4,020,853 | A | 5/1977 | Nuttall | |
| 4,121,598 | A * | 10/1978 | Hornsby | 131/194 |
| 4,362,169 | A | 12/1982 | Calkins | |
| 4,870,979 | A * | 10/1989 | Browning et al. | 131/196 |
| 6,418,937 | B1 * | 7/2002 | Cristiano | 131/215.2 |

FOREIGN PATENT DOCUMENTS

| | | | |
|---|---|---|---|
| DE | 29908307 | U1 | 4/2000 |
| GB | 1458683 | A | 12/1976 |

* cited by examiner

*Primary Examiner*—Carlos Lopez
(74) *Attorney, Agent, or Firm*—Shoemaker and Mattare

(57) ABSTRACT

The present invention is directed to a disposable shank trap for use with a pipe to filter smoke from the burning chamber. The shank trap can include or be associated with other filters to further filter smoke. The advantage of the shank trap is that it can be easily replaced, avoid problems with the cleaning of the pipe, provide efficient filtering of the smoke and efficient usage of the tobacco.

10 Claims, 10 Drawing Sheets

(a)

(b)

(c)

(a)

(b)

(a)

(b)

(a)

(b)

DISPOSABLE FILTER MEANS FOR SMOKING

This application is a continuation-in-part of U.S. application Ser. No. 10/496,492, filed May 24, 2004, which is based on PCT/AU02/01554, filed Nov. 15, 2002.

FIELD OF INVENTION

The present invention relates to smoking and smoking devices. The present invention has particular but not exclusive application to disposable accessories and parts for pipe and cigarette holders.

BACKGROUND OF THE INVENTION

When smoking tobacco from either a pipe, cigarette holder or cigarette, the smoke includes nicotine, moisture, tar and other burnt tobacco byproducts. The pipe and holder usually includes a filter in the stem to limit the amount of burnt byproducts being inhaled by the smoker. With the pipe and holder, the elongate stem also assists in limiting the amount of burnt byproducts reaching the smoker, because the smoke loses heat and the suspended waste changes from a gaseous phase to a solid or liquid phase and consequently is trapped by the filter.

With time, the waste byproducts clog the pipe preventing smoke from passing through the internal passage. Consequently, the pipe and cigarette holder require regular cleaning. The cleaning of pipes and cigarette holders is a laborious task repeated on a regular basis. Furthermore, the cleaning of pipes and cigarette holders usually leaves some waste thereby contaminating subsequent smoke passing through the stem and lessening the enjoyment derived from smoking.

In addition, the area immediately in communication with the exit portal of the burning chamber is often burnt as a consequence of the high temperature of the smoke reducing the ability of the area to filter the smoke. Eventually the pipe or holder must be replaced because of the damaged area adjacent the burning chamber.

These problems are an ongoing source of frustration to smokers as effective filtering of the smoke is reduced. Where filtering is reduced over a period of time, the smoker's health can be adversely affected. As well, the regular ongoing requirement to clean the pipes and holders before a person can enjoy having a smoke often turns the person away from using such smoking devices.

OBJECT OF THE INVENTION

It is an object of the present invention to provide an alternative smoking filter means that overcomes at least in part one or more of the abovementioned problems.

SUMMARY OF THE INVENTION

In one aspect the present invention broadly resides in a disposable receiving member for use within a pipe or holder to receive smoke from a burning chamber or area and collect waste from passaged smoke and other end products.

The disposable receiving member is preferably in close proximity to the burning chamber and is made of materials that can withstand high temperatures.

The disposable receiving member for use within a pipe or holder to receive smoke from a burning chamber or area and collect waste from passaged smoke and other end products is preferably made of ceramics, metal or a combination thereof to withstand the high temperatures associated with the burning chamber and smoke.

In one preferred embodiment, the disposable receiving member has at least an inner ceramic layer for absorbing moisture and some exudates. In an alternate embodiment, the disposable shank is made of timber and a charcoal inner liner is formed after the timber has been burnt from the passaging hot smoke.

Preferably the receiving member can be made of any suitable material comprising ceramic, clay, wood, glass, heat resistant plastics material and metal or combinations thereof.

In another aspect the present invention broadly resides in a disposable receiving member for use within a pipe or holder and has a carbon filter, paper or gauze filter or other similar filter means for removing particulates from the smoke. Other filter material include filter materials, balsa wood, silica gel crystals, fibrous material, charcoal pellets and absorbent paper.

In another embodiment the disposable receiving member is shaped to trap moisture and exudate within the receiving member by means of a liquid trap within the passage through which smokes passes from the burning chamber to the stem.

The receiving member is preferably shaped to resist burning from the high temperatures and embers generated from the burning product.

The receiving member is preferably made of temperature resistant materials to prevent the burning of the receiving member from high temperatures associated with the burning chamber and smoke and the production of embers from the burning product. In a preferred embodiment, the receiving member has an outer metal casing and an inner ceramic layer.

Preferably the receiving member has a passage that allows smoke to enter at or adjacent to one end of the receiving member and exit adjacent another end of the receiving member.

In one preferred embodiment the receiving member is shaped so that its outer surface facilitates heat exchange. In one preferred form the outer surface of the receiving member has one or more laterally extending fins. In one preferred form the outer surface of the receiving member is elongate and may include laterally extending fins. The ability to lower the temperature of smoke passing through the receiving member increases the amount of waste cooled to solid or liquid form that may be trapped by the receiving member.

The disposable receiving member may be inserted as part of a bowl member or be part of a stem portion of a pipe or cigarette holder.

The disposable receiving member may be retrofitted to suitable pipes and cigarette holders.

In another aspect the present invention broadly resides in a disposable receiving member and a stem portion for use within a pipe or holder, said receiving member and filter means forms a single disposable unit for filtering smoke. The filter means is preferably a filter housing and filter insertable within the stem portion of a pipe or cigarette holder.

In another aspect the present invention broadly resides in a device for smoking comprising a bowl member having a burning chamber with an exit portal for providing an outlet for smoke;

a disposable receiving member in communication with the exit portal of the burning chamber, said receiving member is adapted to collect waste from passaged smoke and other end products from a burning product in the burning chamber;

a stem portion in communication with the receiving member; wherein in use smoke passes from the burning chamber through the receiving member and to the stem portion.

Said disposable receiving member preferably serves as a trap to collect moisture, exudates and or particulate matter from the burnt product.

Said disposable receiving member preferably comprises of ceramics, metal or a combination thereof to withstand the high temperatures associated with the burning chamber and smoke. In one preferred embodiment, the disposable receiving member has at least an inner ceramic layer for absorbing moisture and some exudates. In other embodiments, the disposable receiving member has a carbon filter, paper or gauze filter or other similar filter means for removing particulates from the smoke. In another embodiment the disposable receiving member is shaped to trap moisture and exudate within the receiving member by means of a liquid trap within the passage through which smokes passes from the burning chamber to the stem.

The receiving member is preferably shaped to resist burning from the high temperatures and embers generated from the burning product. The receiving member is preferably made of temperature resistant materials to prevent the burning of the receiving member from high temperatures associated with the burning chamber and smoke and the production of embers from the burning product. In a preferred embodiment, the receiving member has an outer metal casing and an inner ceramic layer. In a preferred embodiment the receiving member has a passage that allows smoke to enter at or adjacent to one end of the receiving member and exit adjacent another end of the receiving member.

The disposable receiving member may be inserted as part of the bowl member. The disposable receiving member may alternatively be part of the stem portion.

In one preferred form the receiving member is shaped so that its outer surface facilitates heat exchange. In one preferred embodiment the outer surface of the receiving member has one or more laterally extending fins. In one preferred form the outer surface of the receiving member is elongate and may include laterally extending fins. The ability to lower the temperature of smoke passing through the receiving member increases the amount of waste cooled to solid or liquid form that may be trapped by the receiving member.

The bowl member, receiving member and stem portion may be a single disposable unit. Preferably the device is an assembly of components. More preferably the device includes a bowl, stem portion and cover and a disposable shank trap and filter. The shank trap and filter may be formed as a single unit or are separate components.

The term product includes tobacco and any other substance that may be suitably smoked.

The device may also include an absorbent filter means within the disposable receiving member. In a preferred embodiment, the device includes an absorbent acetate paper filter within the disposable receiving member.

Alternately or in addition the stem portion may include suitable filter means. The stem portion preferably includes a mouth portion from which a smoker can inhale the smoke. Preferably there is an absorbent paper filter within the stem portion to filter particulate matter from the smoke.

The absorbent paper filter is preferably elongate with fluted outer surface to provide increased surface area for filtering purposes. The absorbent paper filter is preferably removable for disposal or cleaning purposes. The absorbent paper filter is more preferably disposable.

The mouth portion may include a filter means to further filter the smoke.

The bowl member is preferably in the shape of a conventional pipe bowl that is engageable with the receiving member and stem portion so that there is a passage from the burning chamber through the exit portal receiving member and stem portion. In another embodiment the bowl member is preferably shaped to receive a stick shaped smoking product such as a butt-less cigarette. In this way the device serves as a holder and though the product may be burnt outside of the bowl member, smoke nevertheless passes through the bowl member.

In another aspect the present invention broadly resides in a device for smoking comprising a bowl member having a burning chamber with an exit portal for providing an outlet for smoke;

a disposable receiving member for use within a pipe or holder to receive smoke from a burning chamber or area and collect waste from passaged smoke and other end products and made of ceramics, metal or a combination thereof to withstand the high temperatures associated with the burning chamber and smoke, said disposable receiving member is adapted to filter moisture, exudates and or particulate matter from the burnt product; and a stem portion in communication with the receiving member; wherein in use smoke passes from the burning chamber through the receiving member and to the stem portion.

In another aspect the present invention broadly resides in a device for smoking comprising a bowl member having a burning chamber with an exit portal for providing an outlet for smoke;

a disposable receiving member for use within a pipe or holder to receive smoke from a burning chamber or area and collect waste from passaged smoke and other end products and made of ceramics, metal or a combination thereof to withstand the high temperatures associated with the burning chamber and smoke, said disposable receiving member substantially serves as a trap to collect moisture, exudates and or particulate matter from the burnt product; and a stem portion in communication with the receiving member; wherein in use smoke passes from the burning chamber through the receiving member and to the stem portion.

BRIEF DESCRIPTION OF THE DRAWINGS

In order that the present invention can be more readily understood and put into practical effect, reference will now be made to the accompanying drawings wherein.

DETAILED DESCRIPTION OF THE PREFERRED EMBODIMENTS

Figure 1:
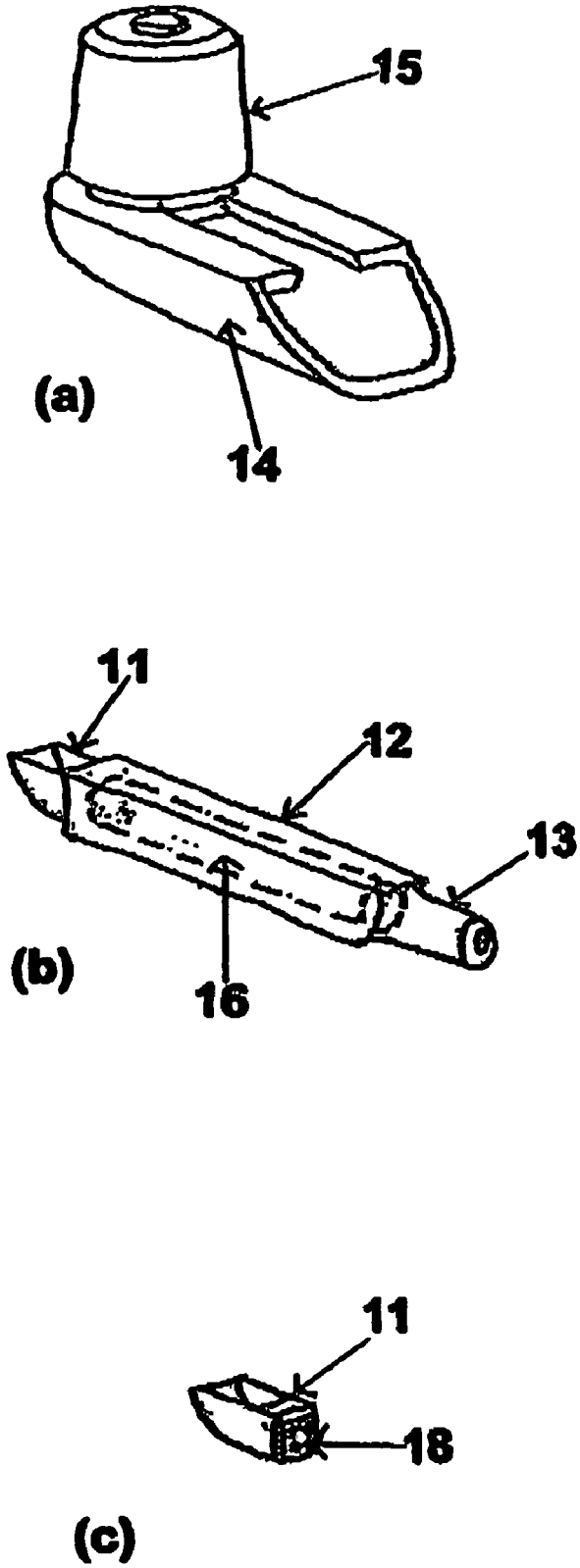
FIG. 1 is a diagrammatic view of the assembly of a first embodiment of the smoking device wherein (*a*) shows stem and bowl, (*b*) shows filter housing and (*c*) shows shank trap.

With reference to FIG. 1, there is shown an unassembled smoking device comprising a receiving member in the form of a shank trap 11, a filter housing 12 with a mouth piece 13, stem 14 and bowl 15. The shank trap 11 is attachable to the filter housing 12 at the opposing end to the mouth piece 13. The filter housing 12 has an acetate paper filter 16 (shown in phantom) locatable within the housing 12. The filter housing 12 with the shank trap 11, when assembled forms a filter assembly locatable within stem 14. The bowl 15 is locatable on the stem 14. When assembled, the burning chamber of the bowl 15 is in communication with the shank trap 11 and the filter housing 12. Smoke from the burning chamber passes into the shank trap 11 as the smoker draws on the mouthpiece 13, the smoke then passes through the paper acetate filter 16 within the filter housing 12 and is inhaled by the smoker. The shank trap 11 is shaped to collect moisture, tar and other end products while allowing smoke to pass through pores 18 in the distal end 19 of the shank trap 11. The acetate paper filter 16 serves to further filter particulates from the smoke before it is inhaled by the smoker. As the smoke passes from the burning chamber, it cools and some waste changes to particulate or liquid form. Some of the particulate and liquid waste is trapped within the shank trap 11. The shank trap 11 and the acetate paper filter 16 are disposable and can be easily replaced with a new shank trap and filter respectively. The shank trap 11 is preferably made of metal such as brass or aluminium with an inner ceramic lining.

Figure 2:
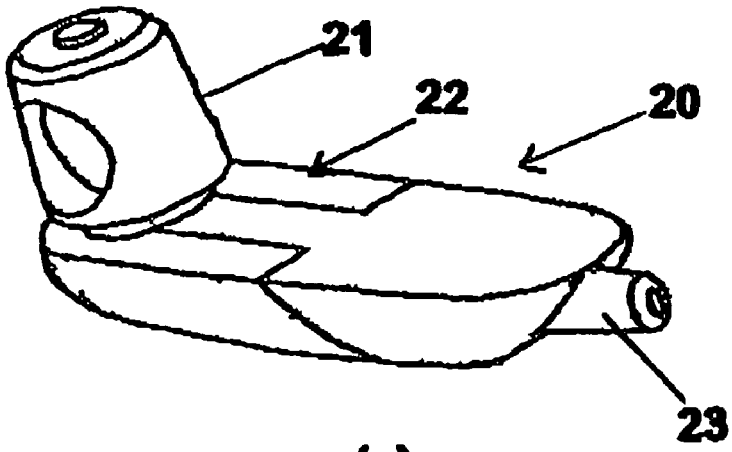
FIG. 2 is a diagrammatic view of a second embodiment of the smoking device wherein (*a*) shows assembled device, (*b*) shows filter housing and (*c*) shows shank trap.
Figure 2:
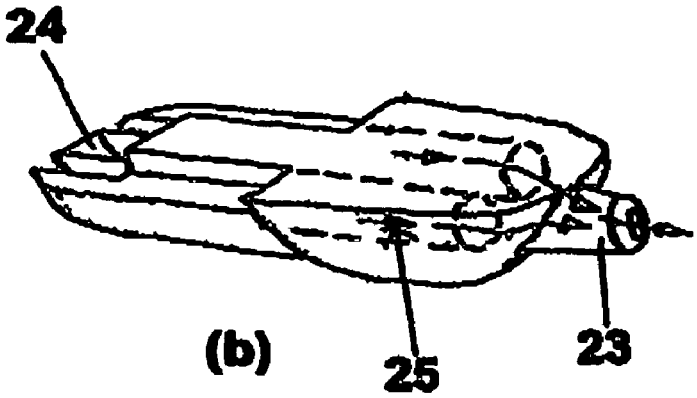
Figure 2:
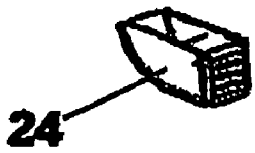
Figure 3:
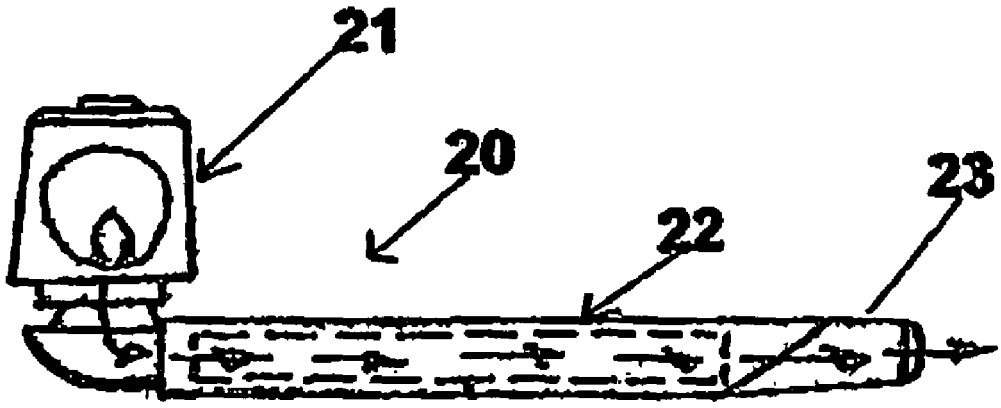
FIG. 3 is an alternate view of the second embodiment of the smoking device wherein (*a*) and (*b*) show assembled device.
Figure 3:
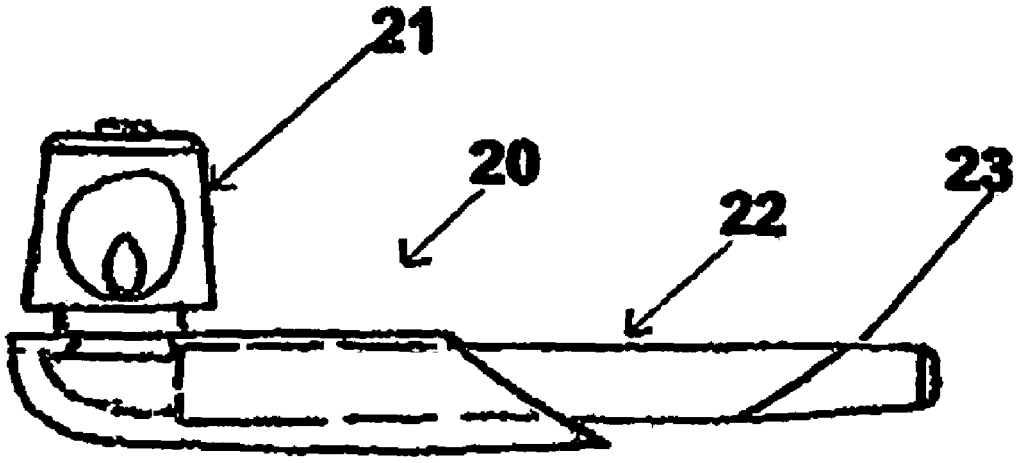

With reference to FIGS. 2 and 3, there is shown a second embodiment of a smoking device 20. The smoking device 20 has a bowl 21, stem 22, mouth piece 23 and shank trap 24. The stem 22 includes two paper filters 25 (shown in phantom). The device 20 shown in FIGS. 2 and 3 is very similar to the device shown in FIG. 1 except with the device 20 the filter housing is part of the stem 22.

Figure 4:
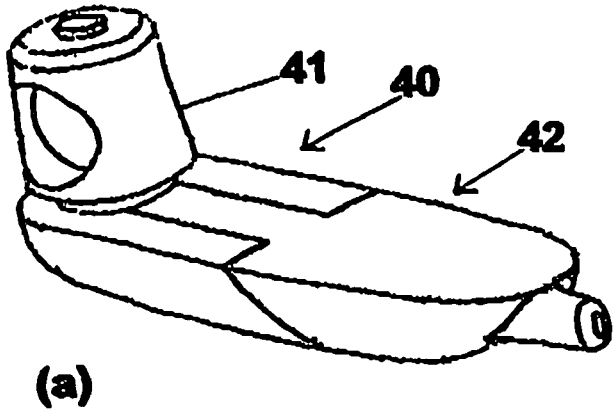
FIG. 4 is a third embodiment of the smoking device wherein the bowl is interchangeable and wherein (*a*) shows an assembled device, (*b*) shows stem and bowl and (*c*) shows bowl.
Figure 4:
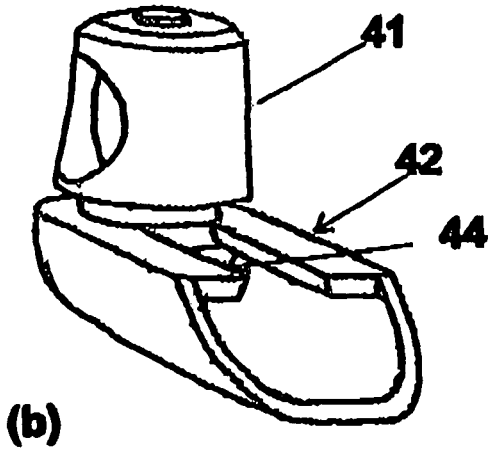
Figure 4:
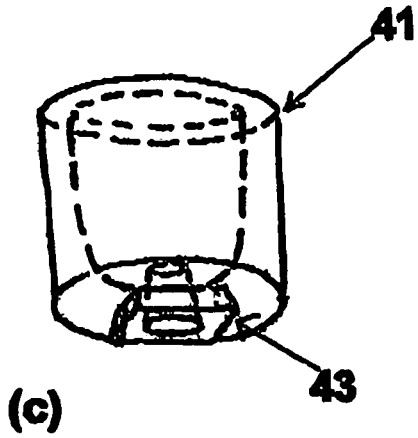

In FIG. 4 there is shown a smoking device 40 wherein the bowl 41 can be removed and replaced by engaging and sliding into position on the stem 42. The bowl 41 has engagement members 43 with inclined sides for sliding along a channel 44 within the stem 42.

Figure 5:
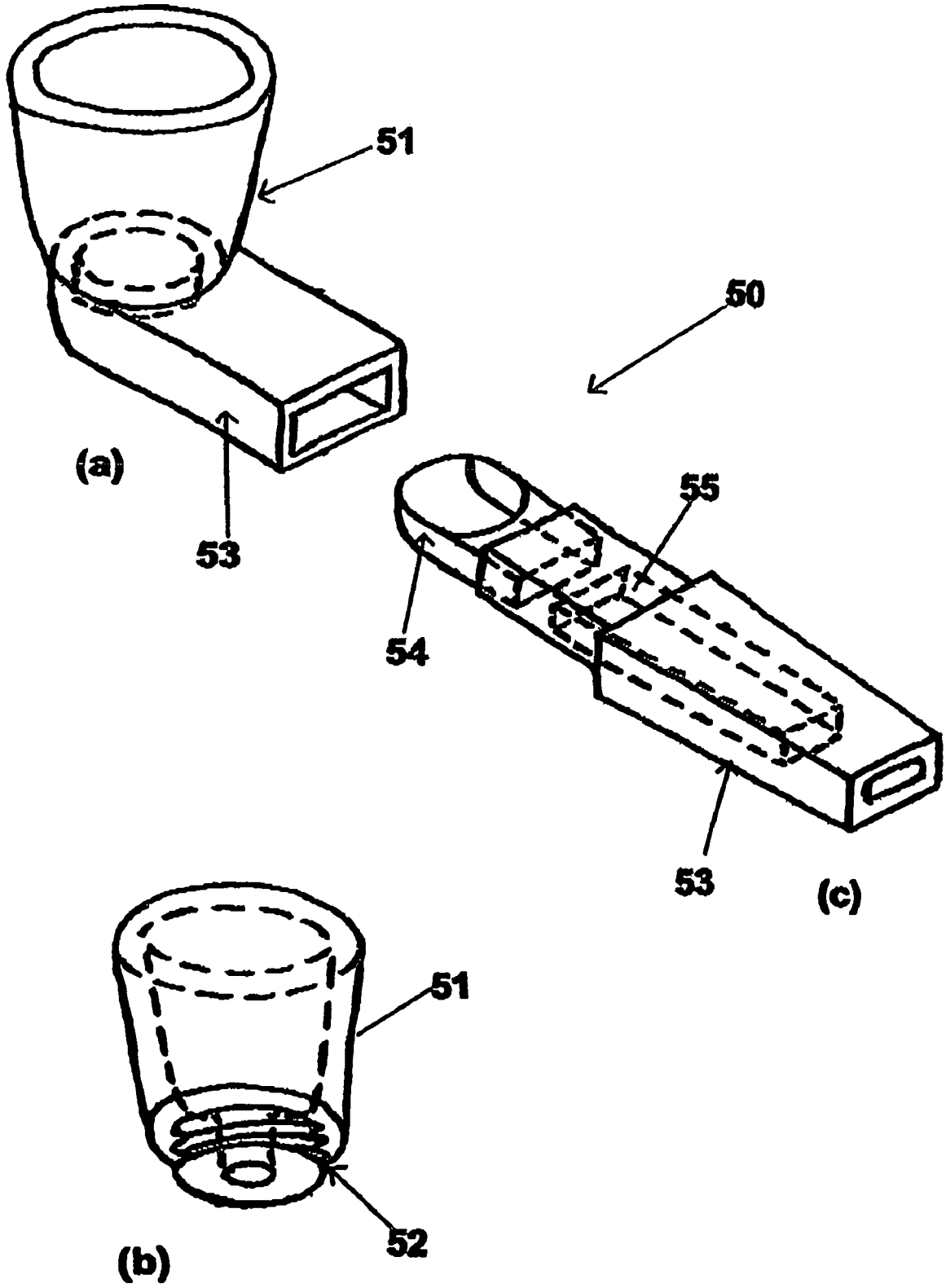
FIG. 5 is a fourth embodiment of the smoking device wherein the bowl can be screwed into position and wherein (*a*) shows bowl fixed to stem, (*b*) shows bowl and (*c*) shows filter housing.

In FIG. 5, there is shown an exploded view of a further embodiment of a smoking device 50 where the bowl 51 is removable by means of a screw thread 52. The bowl 51 can be fixed to the stem 53 within a complementary thread in the stem 53. The smoking device 50 has a filter means comprising a shank trap 54 and paper filter 55.

Figure 6:
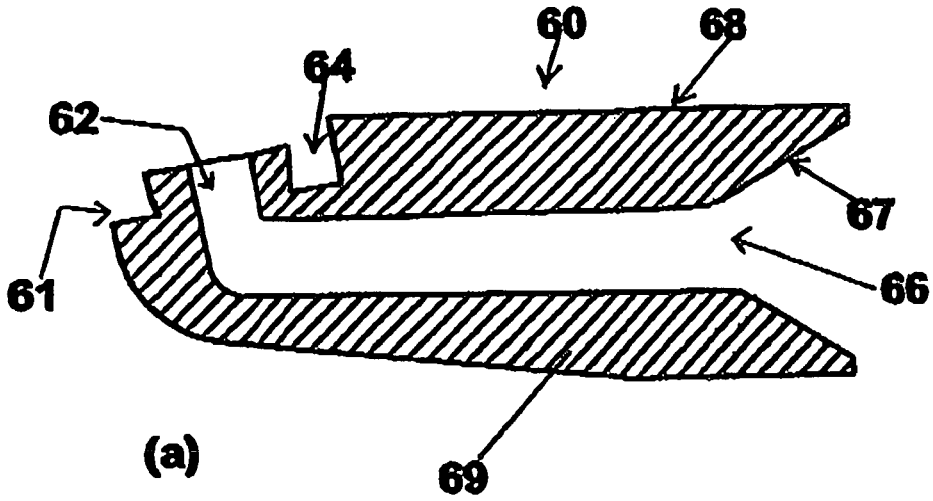
FIGS. 6(*a*) and (*b*) are diagrammatic views of another embodiment of the invention showing a shank trap.
Figure 6:
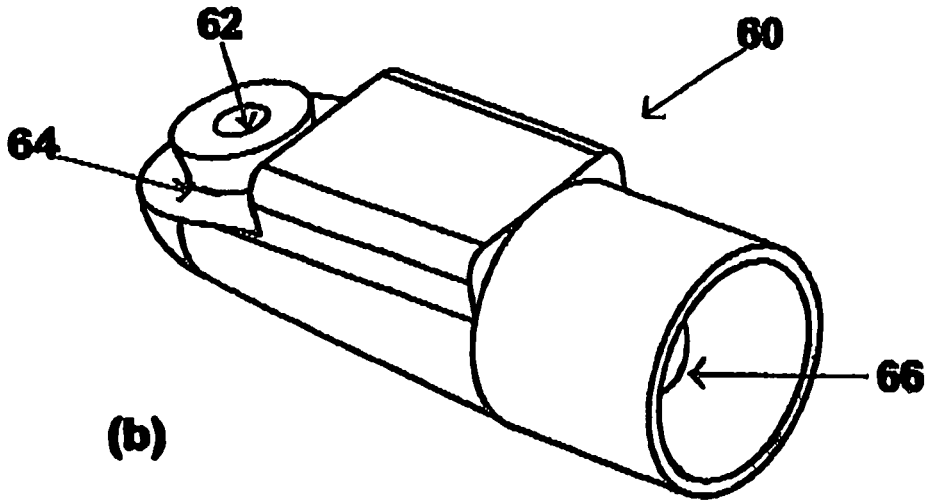
Figure 7:
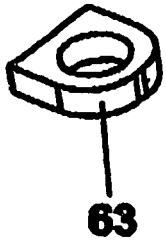
FIG. 7 is a diagrammatic view of a gasket for the shank trap.

In FIG. 6 there is shown a preferred embodiment of the shank trap 60. The shank trap 60 is composed of ceramic material able to absorb moisture and other smoke end products. The shank trap 60 has a bowl end 61 adapted to be fitted to a bowl (not shown). The bowl end 61 has an opening 62 which is in communication with the bowl and burning chamber exit portal (not shown) when fitted. To seal the fitting of the shank trap 60 to the bowl, a rubber gasket 63 (FIG. 7) is fitted around the periphery of the opening 62 within the surrounding recessed portion 64.

The opening 62 is an entry into internal passage 65. Passage 65 has an outlet 66 at the opposing end to opening 62. The outlet 66 has a wide mouth portion 67 to accommodate positioning of a paper filter within the pipe or holder.

The shank trap 60 has an outer metal casing 68 for providing heat resistance and a molded ceramic core 69 for withstanding high temperatures and absorbing moisture and other liquid and gaseous end products.

Figure 8:
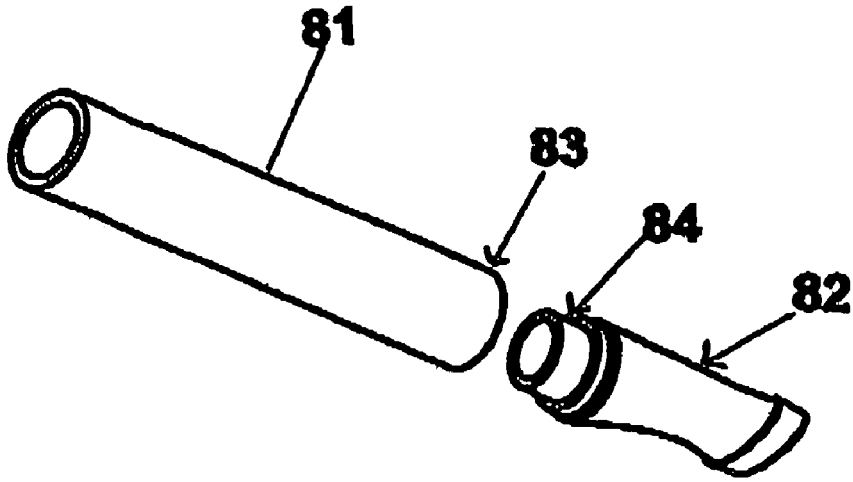
FIGS. 8(*a*) and (*b*) are diagrammatic views of the filter housing and mouthpiece.
Figure 8:
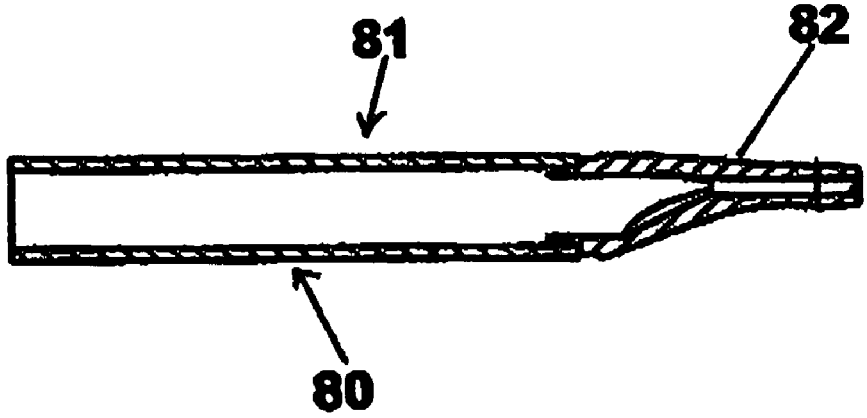
Figure 9:
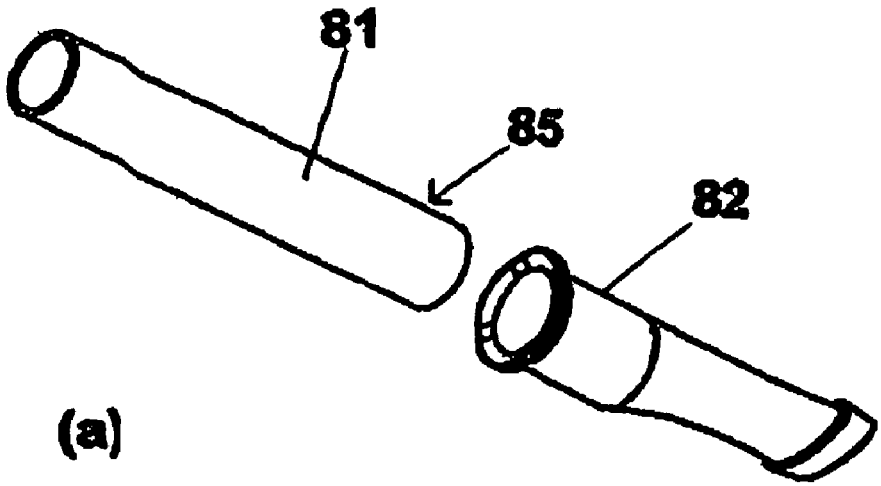
FIGS. 9(*a*) and (*b*) are diagrammatic views of the filter housing and mouthpiece.
Figure 9:
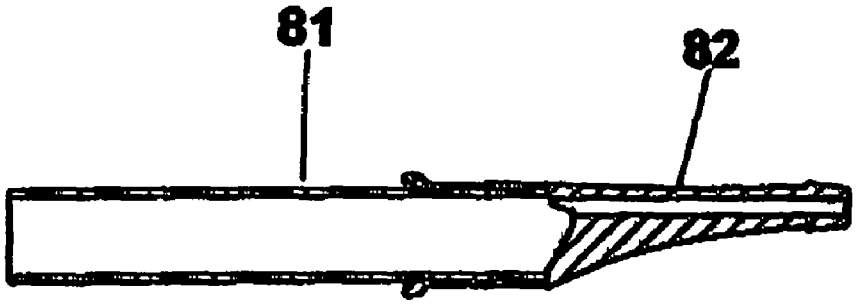
Figure 10:
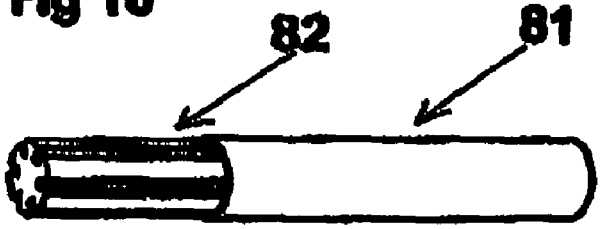
FIG. 10 is a diagrammatic view of the filter housing with a paper filter.

The stem 80 shown in FIGS. 8 and 9 have a filter housing 81 and mouthpiece 82. The embodiment shown in FIG. 8 shows the mouthpiece 82 having a recessed end 84 that fits within housing end 83. Alternately, the mouthpiece 82 can friction fit over one end 85 of the housing 81 (shown in FIG. 9).

Within filter housing 81 there is positioned an acetate paper filter 82 which has a substantially cylindrical form with a fluted outer surface 88 to provide an increased surface area for the filtering of smoke.

The shank trap 60 can fit substantially within the end 89 of the filter housing 81 that is opposed to the mouthpiece 82. The shank trap 60 is then fitted to the bowl (not shown). The filter housing 81 is then friction-fitted to the bowl, thereby encasing the shank trap 60 in an operational position.

After use or when the pipe requires cleaning, the shank trap 60 and filter 82 is replaced and the used parts disposed. In this way efficient filtering is maintained and the frustration of cleaning is avoided by using replacement parts.

Figure 11:
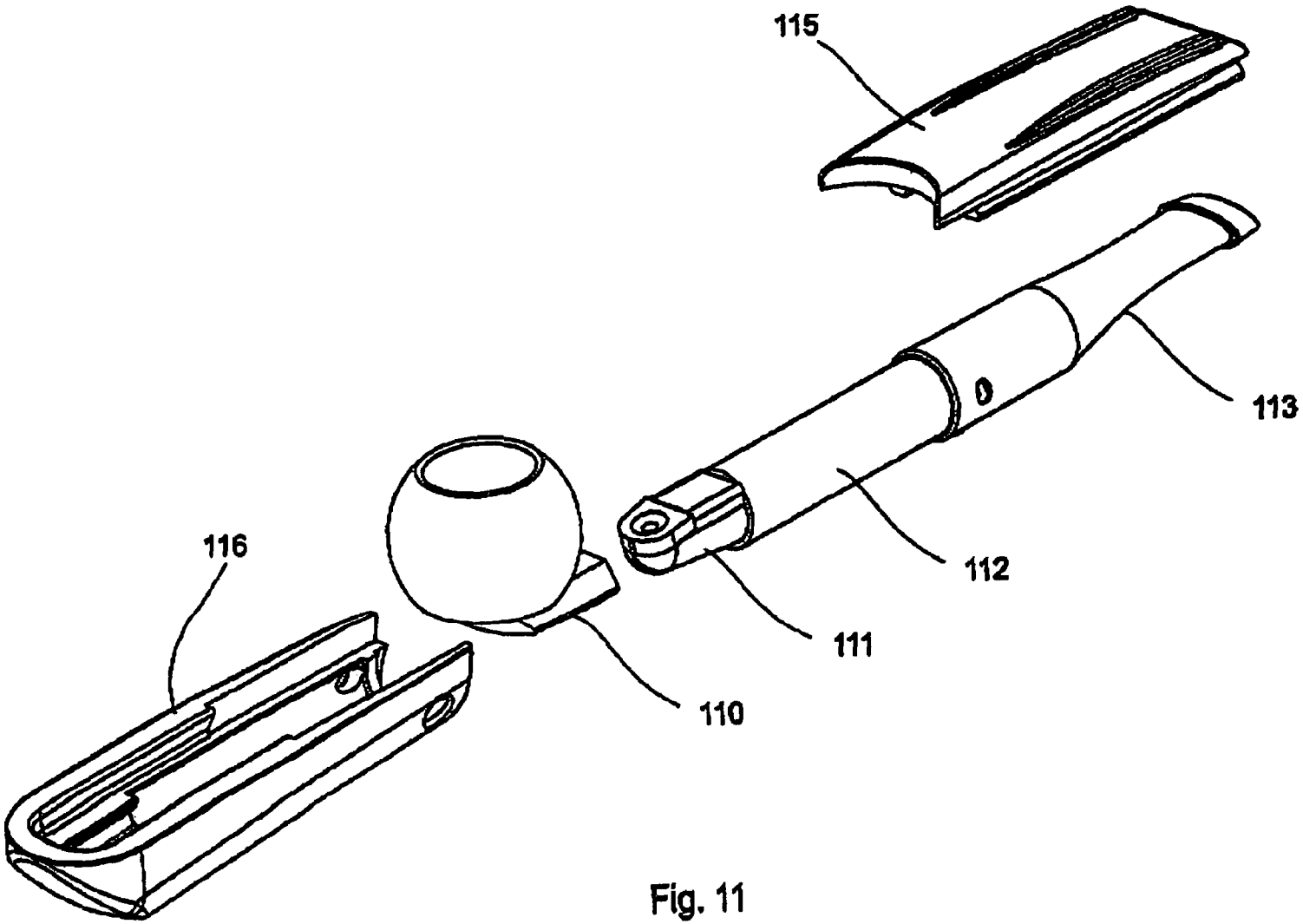
FIG. 11 is an exploded view of a fifth embodiment of the device.

In FIG. 11, a further embodiment of the smoking device is shown with bowl 110, shank trap 111, filter housing 112 with mouth piece 113, stem 114 and stem cover 115.

Figure 12:
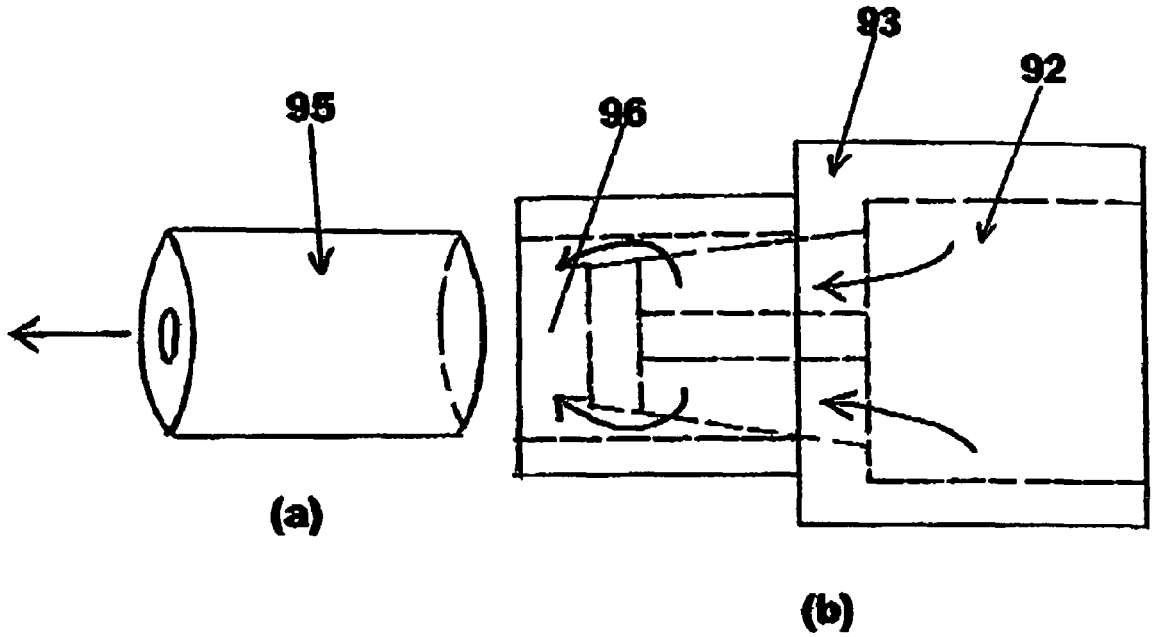
FIG. 12 is a diagrammatic view of a shank trap for a cigarette holder where (*a*) is a cap, (*b*) is a filter portion and (*c*) shows an end view of the filter portion.
Figure 12:
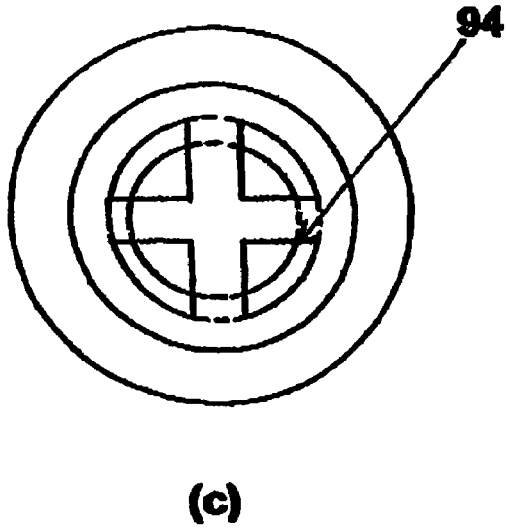

In a further embodiment shown in FIG. 12, a shank trap 90 can be fitted (and retrofitted) into a cigarette holder 91. The shank trap 90 has a U-shaped bowl 92 for holding the cigarette in position so that smoke can be drawn through the cigarette and the shank trap 90 as the smoker inhales. While at least the initial burning does not occur in the bowl 92, the bowl 92 is required to hold the cigarette and enable smoke to be drawn through to the mouthpiece. When fitted to the cigarette holder, the shank trap 90 has a filter portion 93 in the form of a ceramic net 94 through which smoke passes and out through a covering cap 95 which is locatable over the net 94. The covering cap 95 has a centrally located opening 97. Smoke passes over the ceramic surfaces of the net 94 which filters the moisture and gaseous end products and then collects in chamber 96 formed by the cap 95 and net 94. The collected smoke has cooled by the time it reaches the chamber 96 and some smoke end products change phase to liquid and particulate matter and are trapped in the chamber 96. Only smoke passes out of opening 97 in the cap 95. Smoke then passes through the mouth piece 98 of the cigarette holder 91.

The fitting of the shank trap to a cigarette holder provides a means of filtering the smoke from a cigarette without using a conventional cigarette butt. The shank trap is furthermore disposable and can be replaced with a new shank trap when cleaning is required.

Advantages

The present embodiment of the shank trap provides the advantage that it is substantially heat resistant, can absorb moisture and other smoke end products and in some embodiments trap liquid waste and particulate end products and is disposable avoiding the need to clean pipes and holders. In this way efficient filtering of smoke can be maintained without ongoing cleaning problems. Furthermore efficient use of tobacco can be achieved. With the shank trap for the cigarette holder, the entire cigarette can be smoked thus saving on costs and wasting less tobacco. Furthermore there is no need for cigarette butts.

Variations

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

We claim:

1. A disposable shank trap positionable between the burning chamber and stem portion of a pipe or holder and having an internal passageway for the passage of smoke, wherein said shank trap has an outer metal casing to facilitate heat transfer and a ceramic core to withstand high temperatures and absorb moisture and exudate from the smoke, and said ceramic core substantially surrounds said passageway, wherein the smoke cools as it passes along the passageway and moisture and exudate are trapped in the shank trap.

2. A disposable shank trap as claimed in claim 1, wherein there are one or more laterally extending fins on the outer metal casing to facilitate heat exchange.

3. A disposable shank trap as claimed in claim 1, wherein the shank trap is elongate and the internal passageway is angled for directing a flow of smoke from the burning chamber to the stem portion.

4. A disposable shank trap as claimed in claim 1, wherein there are one or more laterally extending fins on the outer metal casing to facilitate heat exchange, the shank trap is elongate and the internal passageway is angled for directing a flow of smoke from the burning chamber to the stem portion.

5. A disposable shank trap as claimed in claim 1, wherein the trap is elongate with the internal passageway being substantially L shaped with an opening in an upper portion through which smoke enters from the burning chamber and passes downward and along the longer L shaped arm of the passageway to an opening in a lower portion.

6. A disposable shank trap as claimed in claim 1, wherein the trap is elongate with the internal passageway being substantially L shaped with an opening in an upper portion through which smoke enters from the burning chamber and passes downward and along the longer L shaped arm of the passageway to an opening in a lower portion; wherein the opening in the lower portion is relatively wide to accommodate positioning of a paper filter.

7. A device for smoking comprising a bowl having a burning chamber with an exit portal for providing an outlet for smoke;

a disposable shank trap as claimed in claim 1, said shank trap being in communication with said exit portal of said burning chamber; and a stem portion in communication with said shank trap;

wherein, in use, smoke passes from said burning chamber through said shank trap and to said stem portion.

8. A device as claimed in claim 7, wherein the stem portion comprises a stem cover, mouthpiece and a filter housing, said filter housing when in use houses a disposable cylindrical paper filter that abuts the shank trap, said shank trap friction fits to the filter housing and is enclosed by the stem cover and the bowl.

9. A device as claimed in claim 7, wherein in use the stem portion comprises a stem cover, mouthpiece, a filter housing and a filter whereby the disposable shank trap is positioned partly within the filter housing and adjacent the filter to form an assembled filter housing, said assembled filter housing can be friction fitted to the bowl thereby encasing the disposable shank trap.

10. A device as claimed in claim 7, wherein in use the stem portion comprises a stem cover, mouthpiece, a filter housing and a filter, said stem cover has relatively greater mass than the filter housing and is able to absorb heat from the filter housing thereby assisting the dissipation of heat from passaged smoke.

* * * * *